343-700 MS AU 251 EX
7/17/84 OR 4,460,894

United States Patent [19]

Robin et al.

[11] Patent Number: 4,460,894

[45] Date of Patent: Jul. 17, 1984

[54] LATERALLY ISOLATED MICROSTRIP ANTENNA

[75] Inventors: Seymour Robin, Woodland Hills; Yosef Klein, Northridge, both of Calif.

[73] Assignee: Sensor Systems, Inc., Chatsworth, Calif.

[21] Appl. No.: 477,214

[22] Filed: Mar. 21, 1983

Related U.S. Application Data

[63] Continuation-in-part of Ser. No. 407,108, Aug. 11, 1982.

[51] Int. Cl.[3] ..... H01Q 1/38; H01Q 1/52

[52] U.S. Cl. ..... 343/700 MS; 343/841

[58] Field of Search ..... 343/700 MS, 785, 795, 343/841

[56] References Cited

U.S. PATENT DOCUMENTS

| | | | |
|---|---|---|---|
| 3,541,559 | 11/1970 | Evans | 343/795 |
| 3,766,563 | 10/1973 | Sauer et al. | 343/841 |
| 3,914,767 | 10/1975 | Jones | 343/785 |
| 4,040,060 | 8/1977 | Kaloi | 343/700 MS |
| 4,053,895 | 10/1977 | Malagisi | 343/700 MS |
| 4,063,246 | 12/1977 | Greiser | 343/700 MS |
| 4,069,483 | 1/1978 | Kaloi | 343/700 MS |
| 4,072,951 | 2/1978 | Kaloi | 343/700 MS |
| 4,078,237 | 3/1978 | Kaloi | 343/700 MS |
| 4,089,003 | 5/1978 | Conroy | 343/700 MS |
| 4,101,895 | 7/1978 | Jones, Jr. | 343/708 |
| 4,130,822 | 12/1978 | Conroy | 343/700 MS |
| 4,197,544 | 4/1980 | Kaloi | 343/700 MS |
| 4,197,545 | 4/1980 | Favaloro | 343/700 MS |
| 4,291,311 | 9/1981 | Kaloi | 343/700 MS |
| 4,291,312 | 9/1981 | Kaloi | 343/700 MS |

*Primary Examiner*—Eli Lieberman
*Attorney, Agent, or Firm*—Koppel & Harris

[57] ABSTRACT

A microstrip antenna which includes a ground member, a dielectric element mounted on the ground member and a radiating element on the dielectric element, has been improved by means of a distinct grounding ring of conductive material which is spaced apart from and extends around the radiating element. The grounding ring is connected to a ground member, thereby laterally isolating the antenna and permitting a closer spacing with adjacent antennas. The gap between the radiating element and the grounding ring is different in different directions.

21 Claims, 4 Drawing Figures

LATERALLY ISOLATED MICROSTRIP ANTENNA

This is a continuation-in-part of application Ser. No. 407,108 filed Aug. 11, 1982, now abandoned.

BACKGROUND OF THE INVENTION

1. Field of the Invention

This invention relates to a microstrip antenna, and in particular to a system for isolating adjacent antennas.

2. Description of the Prior Art

Airplanes, helicopters and rockets commonly employ microstrip antennas as radio altimeters. An example of a microstrip antenna is disclosed in "DC Grounded Microstrip Antenna" to Klein, Ser. No. 332,536 (1981), now abandoned. The antennas generate electromagnetic radiation in a direction perpendicular to the plane of the antenna ("the main pattern lobes"). As is known, undesirable lateral radiation and surface currents are also generated generally in the plane of the microstrip antenna. Because of the lateral radiation and surface current, adjacent microstrip antennas had to be spaced apart by approximately 30 inches (0.8 meter) to avoid interfering with each other while maintaining an industry standard 85 db signal isolation. On large airplanes, a 30 inch spacing poses few problems because of the large area of the fuselage. Spacing is more critical on very small airplanes, helicopters and rockets. On certain helicopters, for example, a 30 inch spacing forces the antenna pair to be mounted longitudinally along the fuselage, whereas a transverse orientation is preferable.

Examples of approaches to isolating adjacent antennas are taught in U.S. Patents to Greiser, U.S. Pat. No. 4,063,246 (1977) and Kaloi, U.S. Pat. No. 4,197,544 (1980). In both, the entire plane in which the radiating element is located has a grounding element. In one or more portions, there is an area with no grounding element, and the radiating element is mounted in that area with a uniform gap between the radiating element and the grounding element.

SUMMARY OF THE INVENTION

The principal object of the present invention is to provide a microstrip antenna that can be mounted substantially closer to an adjacent antenna. As will be discussed in greater detail below, the present invention is constructed so that adjacent antennas can be mounted approximately 16 inches (41 cm) apart, with an 85 db lateral attenuation at approximately 14 inches (36 cm).

The microstrip antenna of the present invention comprises a generally planar radiating element mounted on a dielectric, which in turn is mounted on a ground member. A ring of conductive material is spaced apart from and extends at least partially around the radiating element on the dielectric material. The ring is grounded to the ground member and limits lateral radiation and surface currents from the radiating element, thereby permitting a closer spacing between adjacent antennas. The ring is in the same plane as and preferably extends entirely around the radiating member. The ring is connected to the ground member by means of a series of conductive channels which are space apart by no more than approximately one-half wavelength at the antenna's operating frequency.

The ring is asymmetrically positioned around the radiating element. Specifically, the distance between the radiating element and the ring in the direction of the adjacent microstrip antenna is less than the distance between the radiating element of the ring in the direction perpendicular. This latter distance is about fourteen percent of the wavelength of the electro magnetic radiation radiating from the radiating element at the operating frequency. The grounding ring may be less than ⅛ inch (3 mm) wide. The width of the grounding ring is less than the minimum distance between the radiating element and the grounding ring.

BRIEF DESCRIPTION OF THE DRAWINGS

There are four drawing figures.

DETAILED DESCRIPTION OF THE PREFERRED EMBODIMENT

Figure 1:
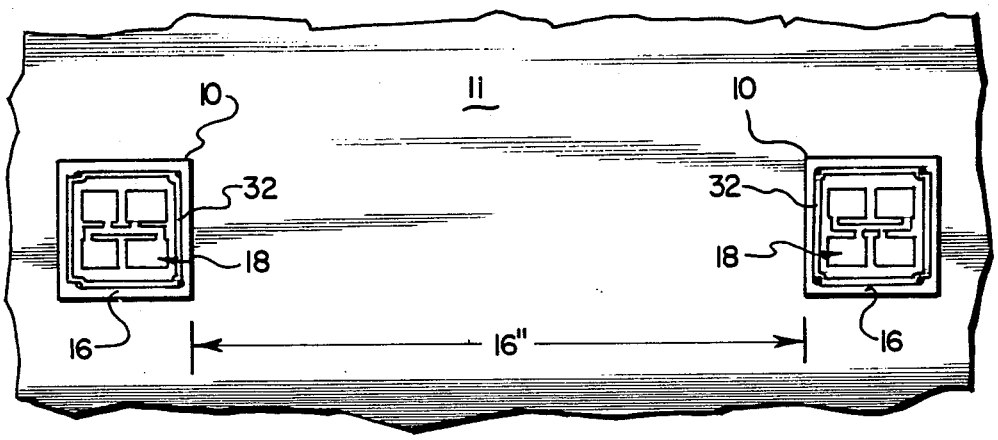
FIG. 1 is a plan view of two adjacent microstrip antennas mounted on the fuselage of an airplane.

As shown in FIG. 1, isolated microstrip antennas 10 constructed in accordance with the present invention are designed to be mounted approximately 16 inches (0.4 meter) from each other on fuselage 11, with each microstrip antenna 10 approximately 3½×3½ inches (9×9 cm) in size. An 85 db lateral attenuation is achieved at approximately 14 inches (36 cm). One antenna would typically be used for transmission and the other for reception.

Each microstrip antenna 10 (FIGS. 2–4) comprises a ground member 15 (FIGS. 3 and 4) and a dielectric element 16 on ground member 15. The ground member is formed from a plate of conductive material such as copper, which can be mounted to an aircraft fuselage, and the dielectric may be fiberglass or plastic. In the exemplary embodiment the dielectric material is teflon.

A generally planar, conductive, radiating element 18 (FIGS. 2–4) is deposited on the dielectric material. In the exemplary embodiment, the radiating element 18 comprises four separate radiating portions 20, 22, 24 and 26 that are electrically connected by a conductive strip 27. The signal is fed to the radiating element 18 by means of a feed pin 19 (FIG. 4), which is in contact with radiating element 18 but which is out of contact with ground member 15. A feed pin arrangement is described in greater detail in Application Ser. No. 332,536.

Although the radiating element 18 is shown in a particular configuration in the exemplary embodiment, the shape of the radiating element could be modified. Kaloi, U.S. Pat. No. 4,072,951 (1978) shows some of the variety of shapes and sizes that are used for certain types of microstrip antennas at various operating frequencies. A number of DC grounding pins 28 extend from each portion of the radiating element 18 to the ground member 15. Pins 28 ground DC and low frequency signals, while permitting the radiation of high frequency signals. Both the shape of the radiating portions of element 18 and the function of pins 28 are discussed in Application Ser. No. 332,536. Four holes 30 are provided near the corners of the antenna assembly for mounting the microstrip antenna 10 to the airplane fuselage.

The microstrip antenna has been improved by providing a ring 32 of conductive material that is spaced apart from and extends at least partially around the radiating element 18, and is grounded to ground member 15. The ring laterally isolates the antenna by a mechanism which is believed to be a combination of an absorption and scattering of surface currents and lateral radiation from the radiating element. As shown in the exemplary embodiment, ring 32 extends entirely around radiating element 18 on the upper surface of dielectric 16 and in the same plane as radiating element 18. Ring 32 is formed from a conductive material which is deposited on the top of dielectric 16, preferably at the same time radiating element 18. In the preferred embodiment the ground ring is an ⅛" wide×0.001" thick (3 mm×0.025 mm) copper strip, which is etched onto the surface of the dielectric. If we assume that the operating frequency is 4.3 Gigahertz ($GH_z$), the wavelength is about 6.98 cm. Therefore, the width of ring 32 is less than 5 percent of the wavelength. The ring may be somewhat wider to about ¼ inch (6 mm), but a wider grounding ring is unnecessary.

Figure 2:
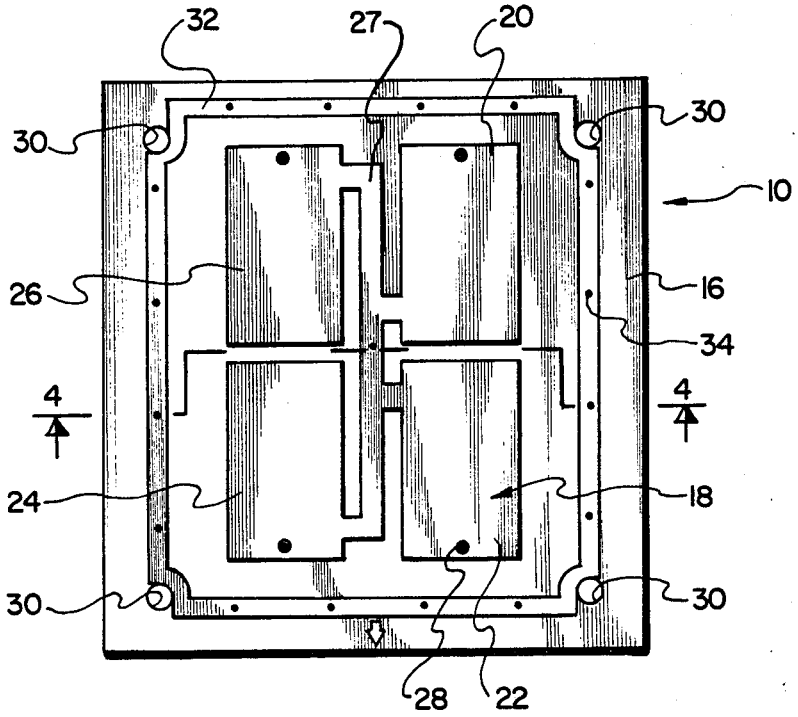
FIG. 2 is a plan view of an antenna constructed in accordance with the present invention. The antenna is shown in an orientation rotated 90 degrees from FIG. 1.
Figure 3:
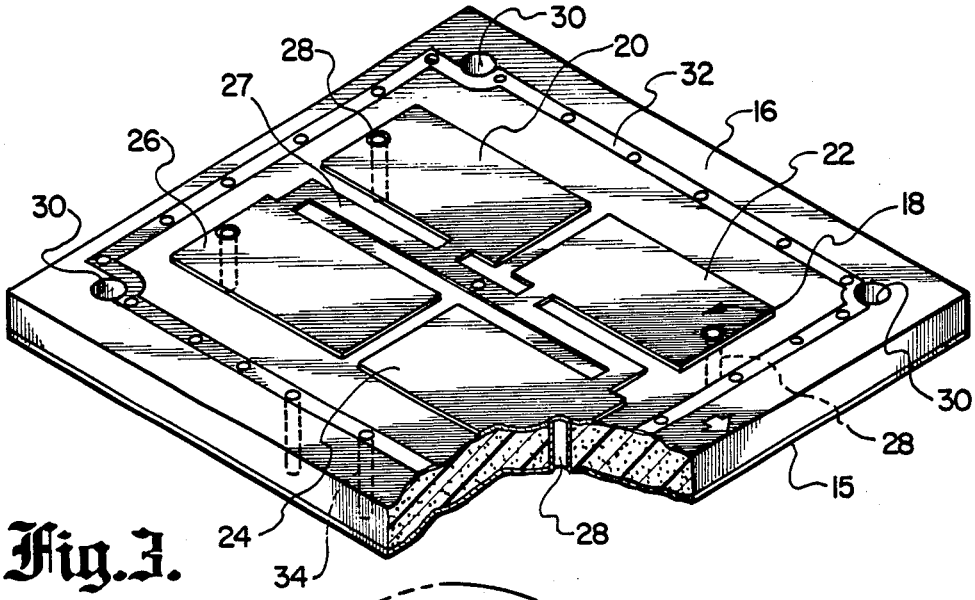
FIG. 3 is a partially cut-away perspective view of the isolated antenna of the present invention.

As noted in FIGS. 2 and 3, gap 40 between radiating element 20 and grounding ring 32 is asymmetrical. To observe the proper orientation between the antennas in FIGS. 1 and 2, note edge 11 in the antenna in FIG. 2 and in the right most antenna in FIG. 1. Gaps 42 and 44 are narrower than gaps 46 and 48. Thus, the space 42 or 44 between radiating element 20 and grounding ring 32 is less in the direction toward the other antenna than the gap 46 or 48 in a direction at a right angle to the first mentioned direction. This can also be expressed in terms of the E and H plane radiations. The H plant radiations radiate in a plane extending between the antennas, and the E plane radiation radiates in a plane perpendicular to a line connecting the two antennas. The gap between radiating element 20 and grounding plane in the E plane direction is greater than the gap 42 and 44 in the H plane.

The minimum gap has been determined experimentally, although at 4.3 $GH_z$ an optimum is reached at about 14 percent of the wavelength (about 9.9 mm of the 69.8 mm wavelength). Adequate antennuation is achieved if gap 46 or 48 is about 0.11 wavelengths wide. The gaps 42 and 44 can be substantially less as shown in FIGS. 2 and 3.

It has been found that the use of separate grounding rings 32 around each of the radiating elements rather than a single grounding element covering the entire space between the antennas results in a greater isolation (30 db rather than 20 db).

Figure 4:
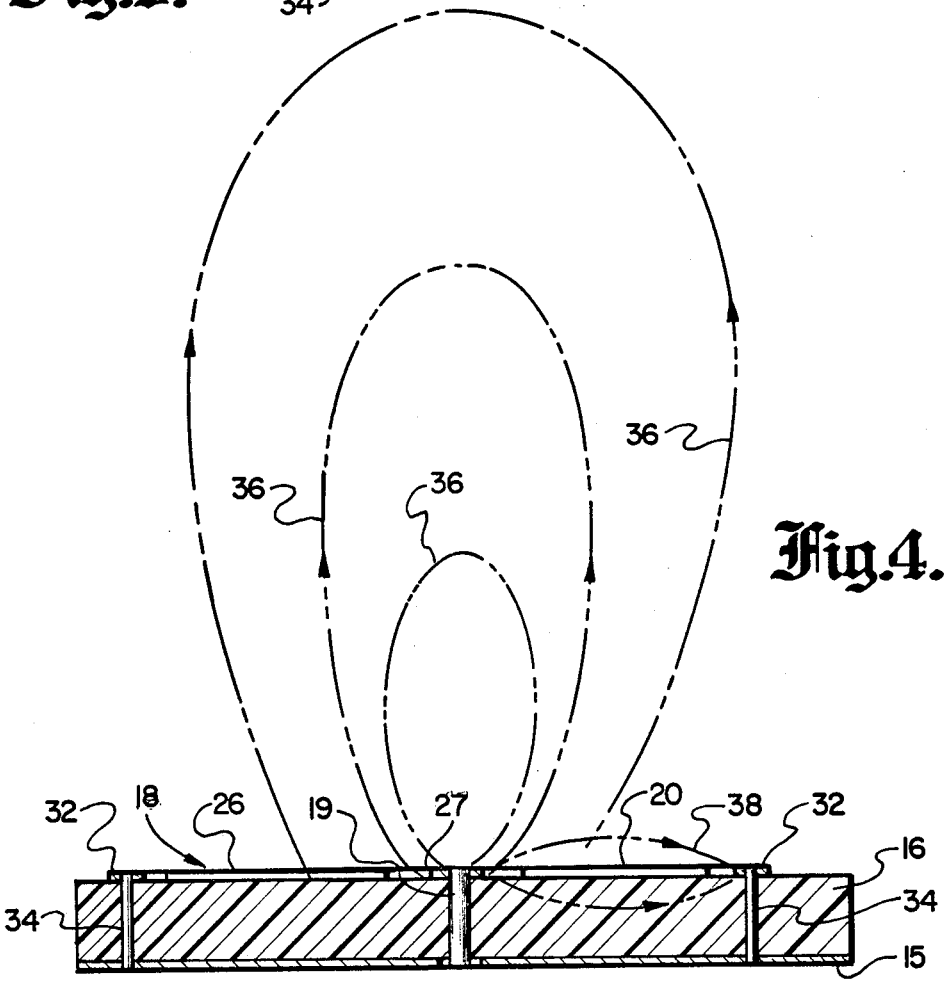
FIG. 4 is a view taken along plane 4—4 of FIG. 2.

Ring 32 is grounded to ground element 15 by means of a series of spaced-apart grounding channels 34 (FIGS. 3 and 4). The grounding channels are drilled through dielectric 16 and their inner surfaces are plated with a conductive material such as 0.001" thick copper to connect ring 32 electrically with ground member 15. The best grounding is achieved by spacing channels 34 from each other by no more than approximately one-half wavelength at the antenna's operating frequency.

A typical radiating pattern is shown in FIG. 4. Most of the radiation extends upward in waves 36 from the surface of radiating element 18. Lateral radiation 38, however, extends laterally and generally parallel to the upper surface of the microstrip antenna where it interferes with the operation of an adjacent microstrip antenna. The lateral radiation in the present invention is isolated by grounding ring 32 such that most of the lateral radiation fails to extend past the ring. This permits an adjacent microstrip antenna to be mounted closer without degrading the operation of either antenna.

A preferred embodiment of the invention has been described, but numerous variations and alternate embodiments will occur to those skilled in the art. For example, a different shaped grounding ring could be used, or a different ground connection for the ring could be provided. Accordingly, it is intended that the invention be limited only in terms of the appended claims.

We claim:

1. An improved microstrip antenna for being mounted generally in a plane in which another antenna is mounted, the first mentioned microstrip antenna comprising a ground member, a dielectric element on the ground member and a generally planar radiating element on the dielectric element for radiating a signal at a radiating frequency, grounding ring means of conductive material spaced from and extending at least partially around the radiating element, and means electrically connecting the ring means to the ground member for limiting lateral radiation from the radiating element in the plane of the radiating element, the improvement comprising the provision of:

the space between the radiating element and the grounding ring means being less in a first direction toward the other antenna than the space between the radiating element and the grounding ring means in a direction at a right angle the first direction.

2. The microstrip antenna of claim 1 wherein the distance between the radiating element and the grounding ring means in a direction opposite the direction toward the other antenna being at least eleven percent of the wavelength of the electromagnetic radiation radiating from the radiating element at the operating frequency.

3. The microstrip antenna of claim 2 wherein the width of the grounding ring means is less than the distance between the radiating element and the grounding ring means.

4. The microstrip antenna of claim 3 wherein the width of the grounding ring means is less than ¼ inch.

5. The microstrip antenna of claim 1 wherein the distance between the radiating element and the grounding ring means in a direction opposite the direction toward the other antenna is about fourteen percent of the wavelength of the electromagnetic radiation radiating from the radiating element at the operating frequency.

6. The microstrip antenna of claim 1, wherein the grounding ring means is in the same plane as the radiating element.

7. The microstrip antenna of claim 1, wherein the grounding ring means extends entirely around the radiating element.

8. The microstrip antenna of claim 1, wherein the improvement further comprises the provision of a plurality of spaced grounding elements extending through the dielectric and connecting the grounding ring means to the ground member.

9. The microstrip antenna of claim 8, wherein the grounding elements are mutually spaced along the grounding ring means by a distance of no more than approximately one-half wavelength at the operating frequency of the microstrip antenna.

10. A microstrip antenna assembly comprising:

a pair of microstrip antennas, each antenna comprising a ground member, a dielectric element on the ground member and a generally planar readiating element on the dielectric element for radiating a signal at a radiating frequency, the antennas being mutually spaced from each other and generally in the same plane, the improvement comprising:

separate planar grounding rings, each laterally spaced from and extending at least partially around each of the antennas, each grounding ring being a plane parallel to the plane of the radiating element of the antenna, and means connecting each of the grounding rings to their respective ground members to isolate laterally the antennas from each other.

11. The microstrip antenna assembly of claim 10, each grounding ring being continuous and extending entirely around its respective antenna.

12. The microstrip antenna assembly of claim 10, wherein the improvement further comprises the provision of a plurality of spaced grounding elements extending through the dielectrics of each antenna and connecting each grounding ring to its respective ground member.

13. The microstrip antenna assembly of claim 10, the antennas being spaced approximately 16 inches apart from each other.

14. An improved microstrip antenna for being mounted in a plane in which another antenna is mounted, the first mentioned microstrip antenna comprising a ground member, a dielectric element on the ground member and a generally planar radiating element on the dielectric element for radiating a signal at a radiating frequency, the improvement comprising:

grounding ring means of conductive material spaced from and extending at least partially around the radiating element for limiting lateral radiation from the radiating element in the plane of the radiating element, and means electrically connecting the grounding ring means to the ground member the distance between the radiating element and the ground ring means in a first direction perpendicular to a line connecting the first mentioned antenna with the other antenna is at least eleven percent of the wavelength of the electromagentic radiation radiating from the radiating element at the operating frequency.

15. The microstrip antenna of claim 14 wherein the width of the grounding ring means is less than the distance between the radiating element and the grounding ring means.

16. The microstrip antenna of claim 14 wherein the width of the grounding ring means is less than ¼ inch.

17. The microstrip antenna of claim 14, wherein the grounding ring means is in the same plane as the radiating element.

18. The microstrip antenna of claim 14, wherein the grounding ring means extends entirely around the radiating element.

19. The microstrip antenna of claim 14 wherein the distance between the radiating element and the grounding ring means in a second direction perpendicular to the first direction is about fourteen percent of the wavelength of the electromagnetic radiation radiating from the radiating element at the operating frequency.

20. A microstrip antenna comprising a ground member, a dielectric element on the ground member and a radiating element on the dielectric element for radiating a signal at a radiating frequency, a strip of conductive material forming a closed loop around the radiating element and generally coplanar with the conductive material, and means grounding the conductive strip, the conductive strip providing isolation for lateral radiation from the antenna, wherein the improvement comprises the provisions of the distance between the strip of conductive material on two sides of the radiating element being greater than the distance between the strip of conductive material on the other two sides of the radiating element.

21. The microstrip antenna of claim 19 wherein the distance between the radiating element and the grounding ring means in the second direction is greater than the distance between the radiating element and the grounding ring means in the first direction.

* * * * *